US006716291B1

(12) United States Patent
Woods

(10) Patent No.: US 6,716,291 B1
(45) Date of Patent: Apr. 6, 2004

(54) CASTABLE MARTENSITIC MOLD ALLOY AND METHOD OF MAKING SAME

(75) Inventor: Charles M. Woods, West Manchester, OH (US)

(73) Assignee: Global Manufacturing Solutions, Inc., Franklin, OH (US)

( * ) Notice: Subject to any disclaimer, the term of this patent is extended or adjusted under 35 U.S.C. 154(b) by 4 days.

(21) Appl. No.: 10/078,656

(22) Filed: Feb. 19, 2002

Related U.S. Application Data

(60) Provisional application No. 60/270,027, filed on Feb. 20, 2001.

(51) Int. Cl.[7] ..... C22C 38/44; C22C 38/54; C21D 10/00

(52) U.S. Cl. ..... 148/325; 148/327; 148/335; 148/540; 148/542

(58) Field of Search ..... 148/325, 327, 148/335, 540, 542, 606, 579, 621; 420/106, 108, 52, 57

(56) References Cited

U.S. PATENT DOCUMENTS

| | | | | |
|---|---|---|---|---|
| 5,433,798 A | * | 7/1995 | Takano et al. | 148/325 |
| 5,650,024 A | | 7/1997 | Hasegawa et al. | |
| 5,798,082 A | | 8/1998 | Kadoya et al. | |

* cited by examiner

*Primary Examiner*—Deborah Yee
(74) *Attorney, Agent, or Firm*—Wegman Hessler & Vanderburg

(57) ABSTRACT

A castable martensitic mold alloy and process for preparing same are disclosed. The composition is characterized by a ductile fine grain tempered martensite having an HRC of about 40 to about 50. The process includes forming a molten fixture of the components and then slow cooling same without requiring an additional tempering heat treatment step as is required in conventional techniques. The components comprise: a) from about 5.0–15% Cr; b) from about 0.5–15% Ni; c) from about 0.1–10% Mo; d) not more than about 2% Si; e) from about 0.1–2% Mn; f) from about 0.1–2% C; g) not more than about 1% S; h) not more than about 1% P; i) not more than about 5% B; j) and the balance being substantially Fe.

17 Claims, No Drawings

CASTABLE MARTENSITIC MOLD ALLOY AND METHOD OF MAKING SAME

RELATED APPLICATION

Priority benefit of U.S. provisional application, Serial No. 60/270,027, filed Feb. 20, 2001, is hereby claimed.

FIELD OF THE INVENTION

The invention relates to a castable steel composition including a martensitic matrix structure and methods for forming such composition.

BACKGROUND OF THE INVENTION

Iron based materials are commonly heat treated to improve strength. Typically, carbon steels are rapidly quenched from the face centered austenitic phase to form martensite. This resulting structure is characterized as a body-centered tetragonal lattice (distorted body-centered cubic) with the degree of distortion being proportional to the amount of trapped carbon.

Martensite is exceptionally strong, hard and brittle. Because it lacks good toughness and ductility, a heat treatment of between about 300°–1200° F. known as tempering is usually employed to improve toughness by redistributing some of the carbon from the solution to yield a mixture of stable ferrite and cementite phases.

Both the quenching and tempering stages are time and energy intensive. It is therefore an object of the invention to provide a strong, hard, ductile martensitic steel in which the quenching and tempering steps are eliminated.

SUMMARY OF THE INVENTION

The present invention is directed to a specialty alloy specifically formulated to produce an as-cast structure comprised of a ductile fine grain tempered martensite phase exhibiting a hardness of HRC 40 to HRC 50. The ductile martensite phase is a matrix consisting primarily of iron, chromium, nickel and molybdenum. A fine grained microstructure of fully tempered martensite forms, upon cooling from the liquid phase, as a casting is slow cooled from a pour. The alloy is unique, in that it forms martensite at a high temperature during the cooling cycle, and then the residual heat in the casting tempers the martensite such that the resulting room temperature structure is one of essentially all fine tempered martensite.

As set forth above, typically alloys must be quenched rapidly in air, oil or water to a relatively low temperature above or below room temperature in order to form the brittle fresh martensite structure. The fresh martensite structure then needs to be reheated to a tempering temperature, typically from around 300°–1200° F. in order to form the tougher more ductile structure of tempered martensite.

The alloy of the present invention forms fresh martensite at a sufficiently high enough temperature during the cooling cycle of the casting so that this fresh martensite becomes tempered during the remaining cooling cycle of the casting. This results in a single pour cycle that produces a uniform tempered martensite throughout the casting without subsequent heat treatment. This alloy must cool slowly to adequately form the tempered martensite structure. That is why the alloy is so well suited to the casting process, which is a naturally slow cooling process.

The present invention provides many benefits. The alloy microstructure that forms during cooling results in an alloy that has excellent strength, ductility, toughness and wear resistance, due to the formation of the fine grained martensitic structure. This combination of properties and alloy structure were formerly only available by performing a quench and tempering heat treatment process. Also, the combination of elements, primarily chromium, nickel. And molybdenum, gives this alloy excellent resistance to corrosion.

DETAILED DESCRIPTION

Exemplary alloy compositions in accordance with the invention may comprise:

| | | |
|---|---|---|
| Iron | 52–94.2 | weight percent |
| Chromium | 5.0–15 | weight percent |
| Nickel | 0.5–10 | weight percent |
| Molybdenum | 0.1–10 | weight percent |
| Si Metal | 0–2 | weight percent |
| Manganese | 0.1–2 | weight percent |
| Carbon | 0.1–2 | weight percent |
| Sulfur | 0–1 | weight percent |
| Phosphorus | 0–1 | weight percent |
| Boron | 0–5 | weight percent |

With the foregoing adding up to 100 weight percent.

Preferred alloy compositions are as follows:

| | | |
|---|---|---|
| Iron | 86.5–90.3 | weight percent |
| Chromium | 8.0–9.0 | weight percent |
| Nickel | 1.0–2.0 | weight percent |
| Molybdenum | 0.5–0.7 | weight percent |
| Si Metal | 0.75 (max) | weight percent |
| Manganese | 0.75 (max) | weight percent |
| Carbon | 0.15–0.2 | weight percent |
| Sulfur | 0.03 (max) | weight percent |
| Phosphorus | 0.04 (max) | weight percent |
| Boron | 0.1 (max) | weight percent |

A typical furnace charge mix for the alloy is as follows:

| | |
|---|---|
| Iron | 88.1 lb |
| Chromium | 9.0 lb |
| Nickel | 2.0 lb |
| Si Metal | 0.3 lb |
| Molybdenum | 0.6 lb |
| El Mn | 0.3 lb |
| Carbon | 0.2 lb |
| | Usually added with the Fe |
| Boron | 0.1 lb |
| Sulfur | impurities |
| Phosphorus | impurities |

Iron, nickel, chromium, molybdenum, manganese, silicon, and carbon are added to the melt at the initial charge. The boron is added after the metal has become molten and before the metal is poured to assure good homogenization without risking the loss of this element to reaction with any dissolved hydrogen and nitrogen over time during the melting process.

Three specific separate alloy pour compositions of the above nominal composition were poured:

| Pour #1 | |
|---|---|
| Iron | Rem |
| Chromium | 8.76 weight percent |
| Nickel | 1.95 weight percent |
| Si Metal | 0.67 weight percent |
| Molybdenum | 0.51 weight percent |
| Manganese | 0.62 weight percent |
| Boron | 0.11 weight percent |
| Phosphorus | 0.01 weight percent |
| Sulfur | 0.01 weight percent |
| Carbon | 0.18 weight percent |

Pour #2 and Pour #3 were poured the same but were not analyzed for composition only for microstructure, hardness and machinability.

All three of these pours produced acceptable microstructures through the thickness of the castings (roughly 10×6×10 inches). These pours were melted in an argon blanketed induction furnace and poured into the molds through air. The molds were blanketed with K-wool insulating material and allowed to cool slowly.

Metallography from Heat #1, exhibited an excellent martensitic microstructure.

It appears that the preferred microstructure from Heat #1 is martensite with no tendency towards the formation of pearlite or other microstructures. When cooled slowly, as in the case of a slow cooled casting, or as in the case of the furnace cool, the alloy transforms to martensite and then self tempers, resulting in a tempered martensite microstructure at room temperature. This same microstructure was observed throughout the casting regardless of position. The fine martensitic structure that forms produces hardness in the range from Rockwell C 40 to Rockwell C 50. It is also responsible for the high strength, good ductility, good toughness and excellent wear resistance of the alloy. The combination of chromium, nickel, and molybdenum account for the alloy's reasonably good resistance to corrosion. It did not rust when exposed to ambient conditions of temperature and high humidity for a period of over two years.

Additional pours #4 and #5 were prepared as set forth above and also exhibited martensitic microstructure.

| Pour #4 | |
|---|---|
| Carbon | 0.19 weight percent |
| Manganese | 0.17 weight percent |
| Phosphorus | 0.006 weight percent |
| Sulfur | 0.002 weight percent |
| Silicon | 0.20 weight percent |
| Nickel | 1.27 weight percent |
| Chromium | 8.06 weight percent |
| Molybdenum | 0.51 weight percent |
| Iron | Rem |

| Pour #5 | |
|---|---|
| Carbon | 0.17 weight percent |
| Manganese | 0.21 weight percent |
| Phosphorus | 0.004 weight percent |

-continued

| Pour #5 | |
|---|---|
| Sulfur | 0.002 weight percent |
| Silicon | 0.26 weight percent |
| Nickel | 1.26 weight percent |
| Chromium | 8.86 weight percent |
| Molybdenum | 0.51 weight percent |
| Iron | Rem |

The components are melted and mixed in the melt under an argon blanket or inert atmosphere. The alloy is then poured through air followed by insulated slow cooling to ambient temperature to produce the desired alloy condition. It is not necessary that the alloy be protected via an inert atmosphere during cooling. It is also not necessary for the alloy to be blanketed with argon or an inert atmosphere during melting, except that it provides for a more accurate control of the alloy's final composition and thus a more homogeneous microstructure with uniform properties. Depending on the size of the casting, it may not be necessary to insulate it upon cooling. A simple air cooling may be sufficient.

Normally, the metal is poured into a preheated ceramic shell or other type of mold and then allowed to cool to the surrounding environment; normally ambient although other cooling environments can also be used. Preferably, the alloy is allowed to cool for a period of 8 hours or more.

The thus cast and cooled alloy is particularly useful in industrial applications where good strength and enhanced wear resistance is desired. It is also useful for applications where a hard material is required and there is a need for many sharp corners, small radii, sharp bends small holes, internal cavities with sharp corners etc. That is, for applications where quench and tempering of conventional alloys to achieve the desired tempered martensitic structure would result in high stresses causing unwanted cracking and distortion resulting in failure of the part during the heat treatment. The new alloy can be cast to net, or near net shape already exhibiting the tempered martensitic condition. This allows for the inclusion, within the casting, of many geometrical features that just cannot be produced in alloys requiring conventional heat treating processes. Near net castings of the final part can be made and then finished to a final part by simple machining practices. Also, since the microstructure of this alloy is uniform throughout the part, the part will exhibit excellent dimensional stability throughout it's useful life, unlike other materials used for dies, etc., that distort over time in-service because of changes that take place in their varying microstructures. For example, cast alloys in accordance with the invention can be used to make parts for any company in need of wear resistance or for injection molding applications or die forming applications. This would include abrasive/corrosion needs industries; plastic extrusion, plastic injection molding, pumps for fluids, slurries, wood pulp, oil, sludge, sewage. The alloy is initially developed and tested for use as an injection molding die material that could be cast near-net-shape from a rapid prototype pattern to create an inexpensive rapid turn-around mold making process. The types of parts that can be fabricated include but are not limited to: injection molding dies, extrusion dies, screw flights, sludge pumps, impellers, gears, drill heads, die casting dies, forging dies, tool blanks, finished tool heads, golf clubs, wear shafts.

Although the invention has been described with regard to specific preferred forms and embodiments, it is intended that there be covered as well any changes or modifications therein which may be made without departure from the spirit and scope of the invention as defined in the appended claims.

What is claimed is:

1. A cast steel having a martensite matrix structure and consisting of, based on weight percent:

a) from about 5.0–15% Cr;

b) from about 0.5–15% Ni;

c) from about 0.1 –10% Mo;

d) not more than about 2% Si;

e) from about 0.1–2% Mn;

f) from about 0.1–2% C;

g) not more than about 1% S;

h) not more than about 1% P;

i) not more than about 5% B;

j) and the balance being substantially Fe.

2. A cast steel as recited in claim 1 having an HRC hardness of between about 40–50.

3. A cast steel having a martensite matrix structure and consisting of, based on weight percentage a) from about 8–9% Cr;

b) from about 1–2% Ni;

c) from about 0.5–0.7% Mo;

d) not more than about 0.75% Si;

e) not more than about 0.75% Mn;

f) from about 0.15–0.2% C;

g) not more than about 0.03% S;

h) not more than about 0.04% P;

i) not more than about 0.1% B;

j) and the balance being substantially Fe.

4. A cast steel as recited in claim 3 having an HRC of between about 40–50.

5. A cast steel as recited in claim 3 wherein Cr is present in an amount of about 8.76%; Ni is present in an amount of about 1.95%; Si is present in an amount of about 0.67%; Mo is present in an amount of about 0.51%; Mn is present in an amount of about 0.62%; B is present in an amount of about 0.11%; P is present in an amount of about 0.01%; S is present in an amount of about 0.01%; and carbon is present in an amount of about 0.18%.

6. A cast steel as recited in claim 5 wherein said Fe is present in an amount of about 86.5–90.3%.

7. A cast steel as recited in claim 3 wherein Cr is present in an amount of about 8.06%; Ni is present in an amount of about 1.27%; Si is present in an amount of about 0.20%; Mo is present in an amount of about 0.51%; Mn is present in an amount of about 0.17%; P is present in an amount of about 0.006%; S is present in an amount of about 0.002%; and C is present in an amount of about 0.18%.

8. A cast steel as recited in claim 3 wherein Cr is present in an amount of about 8.86%; Ni is present in an amount of about 1.26%; Si is present in an amount of about 0.26%; Mo is present in an amount of about 0.51%; Mn is present in an amount of about 0.21%; P is present in an amount of about 0.004%; S is present in an amount of about 0.002%; and C is present in an amount of about 0.17%.

9. A process for forming a cast, martensitic mold alloy, said process comprising:

(1) forming a molten mixture, based upon weight, of the following components:

a) from about 5.0–15% Cr;

b) from about 0.5–15% Ni;

c) from about 0.1–10% Mo;

d) not more than about 2% Si;

e) from about 0.1–2% Mn;

f) from about 0.1–2% C;

g) not more than about 1% S;

h) not more than about 1% P;

i) not more than about 5% B;

j) and the balance being substantially Fe (2) allowing the molten mixture to cool to form a fully tempered martensite without further tempering heat treatment.

10. Process as recited in claim 9 wherein said step of forming comprises melting and mixing said components in an inert atmosphere and then pouring said molten mixture through air into an insulated mold.

11. Process as recited in claim 9 wherein said molten mixture is allowed to cool for a period of about 8 hours or more.

12. Process as recited in claim 9 wherein said molten mixture is allowed to cool to about ambient.

13. Process as recited in claim 9 wherein said molten mixture comprises the following components:

a) from about 8–9% Cr;

b) from about 1–2% Ni;

C) from about 0.5–0.7% Mo;

d) not more than about 0.75% Si;

e) not more than about 0.75% Mn;

f) from about 0.15–0.2% C;

g) not more than about 0.03% S;

h) not more than about 0.04% P;

i) not more than about 0.1% B;

j) and the balance being substantially iron, said fully tempered martensite having a hardness HRC of about 40 to about 50.

14. Process as recited in claim 13 wherein Cr is present in an amount of about 8.76%; Ni is present in an amount of about 1.95%; Si is present in an amount of about 0.67%; Mo is present in an amount of about 0.51%; Mn is present in an amount of about 0.62%; B is present in an amount of about 0.11%; P is present in an amount of about 0.01%; S is present in an amount of about 0.01%; and C is present in an amount of about 0.18%.

15. Process as recited in claim 14 wherein said Fe is present in an amount of about 86.5–90.3%.

16. Process as recited in claim 13 wherein Cr is present in an amount of about 8.06%; Ni is present in an amount of about 1.27%; Si is present in an amount of about 0.20%; Mo is present in an amount of about 0.51%; Mn is present in an amount of about 0.17%; P is present in an amount of about 0.006%; S is present in an amount of about 0.002%; and C is present in an amount of about 0.18%.

17. Process as recited in claim 13 wherein Cr is present in an amount of about 8.86%; Ni is present in an amount of about 1.26%; Si is present in an amount of about 0.26%; Mo is present in an amount of about 0.51%; Mn is present in an amount of about 0.21%; P is present in an amount of about 0.004%; S is present in an amount of about 0.002%; and C is present in an amount of about 0.17%.

* * * * *